US005227752A

United States Patent [19]

Ham

[11] Patent Number: 5,227,752

[45] Date of Patent: Jul. 13, 1993

[54] FOCUS MAGNET FOR A PROJECTION TYPE CATHODE-RAY TUBE

[75] Inventor: Sung-U Ham, Suwon, Rep. of Korea

[73] Assignee: Samsung Electron Devices Co., Ltd., Rep. of Korea

[21] Appl. No.: 813,114

[22] Filed: Dec. 23, 1991

[30] Foreign Application Priority Data

Dec. 31, 1990 [KR] Rep. of Korea ..... 90-22168

[51] Int. Cl.[5] ..... H01F 7/00

[52] U.S. Cl. ..... 335/210

[58] Field of Search ..... 335/210–214; 315/5.34, 5.35; 313/440; 250/396 ML

[56] References Cited

U.S. PATENT DOCUMENTS 3,098,943 7/1963 Reiches ..... 313/440

FOREIGN PATENT DOCUMENTS 55143761 4/1954 Japan .

*Primary Examiner*—Leo P. Picard

*Assistant Examiner*—Raymond Barrera

*Attorney, Agent, or Firm*—Majestic, Parsons, Siebert & Hsue

[57] ABSTRACT

The present invention relates to a focus magnet for a projection type cathode-ray tube where a non-magnetic heat insulating member is disposed between a magnet having a penetrating hole formed therein and a coil wound within the magnet, whereby it can minimize a variation of focusing characteristics of an electron beam due to the heat generated in operation of the projection type cathode-ray tube, and improve a degree of roundness of a coil wound within the magnet.

5 Claims, 2 Drawing Sheets

FOCUS MAGNET FOR A PROJECTION TYPE CATHODE-RAY TUBE

FIELD OF THE INVENTION

The present invention relates to a focus magnet for a projection type cathode-ray tube, more particularly to a focus magnet of a projection type cathode-ray tube, which can minimize a variation of focusing characteristics of an electron beam due to the heat generated in the operation of the projection type cathode-ray tube (CRT), and improve a degree of roundness of a coil wound within a magnet.

DESCRIPTION OF THE PRIOR ART

In general, a projection type CRT is constructed as the following description That is, as shown in FIG. 5, a deflection yoke D is provided in a neck portion C of a funnel portion B coupled to a panel portion A so as to deflect a path of an electron beam emitted from an electron gun (not shown) A focus magnet E is disposed at the back side of the deflection yoke D to focus the electron beam. A color purifying magnet F serving as a focusing lens is mounted at the back side of the focus magnet E.

In the above-mentioned construction of the projection CRT, the focus magnet E is generally constructed such that a coil J is wound within a hollow magnet G having a cylindrical shape through an adhesive tape H, as shown in FIG. 4.

With the projection CRT constructed as above, high current and voltage is used in order to achieve a high brightness feature from a functional aspect of the CRT. Accordingly, there is considerable heat generation due to high current and voltage used in the CRT. For this reason, a liquid cooling portion filled with a coolant is provided at the forward side of the panel portion so as to obtain a cooling effect and to improve a quality of a picture to be displayed on a screen.

By the way, certain heat is also generated from the coil J being wound within the interior of the focus magnet E focusing the electron beam and is transferred to the magnet G together with the heat generated during the operation of the CRT. As a result, the magnet G is influenced by the aforementioned heat to occur a variation of the magnetic field characteristics thereof, thereby resulting in a defect that the focusing characteristics may be remarkably deteriorated.

To solve the above-mentioned defect, several techniques have been proposed up to now. Among them, for example, in Japanese patent laid-open publication No. showa 55-143765, there is disclosed a construction that a plurality of yoke plates, each having a central portion on which a penetrating hole for receiving a neck portion of a CRT is formed, are disposed at a predetermined interval A pair of ring-shaped permanent magnets are co-axially disposed between the yoke plates. Each of the permanent magnet has two magnetic poles, i e., the pole S and the pole N, respectively and has an inner portion on which a coil is wound up. With the construction disclosed in the above Japanese patent, since the electron beam may be easily focused, it allows to obtain a stable picture in spite of a variation of temperature of the permanent magnets.

In another example disclosed in Japanese patent laid-open publication No. showa 62-122032, there is described a construction that a temperature compensating means comprises a ring-shaped bobbin made of temperature sensitive magnet material and inserted into an inner surface or outer surface of a ring-shaped permanent magnet and a coil wound around the ring shaped bobbin.

With the construction disclosed in above patent, the temperature compensating means decreases a variation of a central magnetic field to thereby achieve a small size and light-weight of the focus magnet.

According to the above patent publication No. showa 55-143765, however, the intensity of the magnetic field may be decreased and focusing characteristics may be also deteriorated due to an effect of electron repulsion. Also, in the above patent publication No. showa 62-122032, since the ring-shaped bobbin made of temperature-sensitive magnet material is further mounted therein, there are defects that the magnetic field may be varied and the focus magnet is increased in weight.

Further, with the conventional techniques as mentioned above, in case that the CRT is operated for a long time, the heat generated from the CRT and the coil is transmitted to the magnet. As a result, since physical property of the magnet may be varied so that magnetism is deteriorated. Also, the central magnetic field of lens is lowered to thereby deteriorate focusing characteristics of the focus magnet. Moreover, a degree of roundness of the coil can not be properly maintained.

SUMMARY OF THE INVENTION

Accordingly, the present invention has been made to solve the above-mentioned problems and an object to provide a high-quality focus magnet for a projection type cathode-ray tube, which can minimize an amount of the heat transmitted from the cathode-ray tube to a magnet to stably preserve focusing characteristics of the magnet in the operation of the CRT for a long time, and improve a degree of roundness of a coil wound within the magnet.

In order to achieve the object as mentioned above, the present invention provides a focus magnet mounted in a neck portion of a projection type cathode-ray tube, the focus magnet comprises a ring-shaped non-magnetic insulating member disposed between a ring-shaped magnet and a coil to minimize an amount of the heat transmitted from the neck portion and the coil to the magnet and a heat insulating member having a thickness in the range between 0.01 mm and 10 mm, whereby it improves focusing characteristics of the magnet without a variation of physical property of the magnet, and further, improves a degree of roundness of the coil by enhancing an alignment condition of the magnet.

BRIEF DESCRIPTION OF THE DRAWINGS

In the accompanying drawings:

FIG. 2s are graphs showing a test result comparing the focus magnet of the present invention with a conventional focus magnet;

DETAILED DESCRIPTION OF THE PREFERRED EMBODIMENTS

Thereinafter, preferred embodiments of the present invention will be described in detail with reference to the accompanying drawings.

Figure 1:
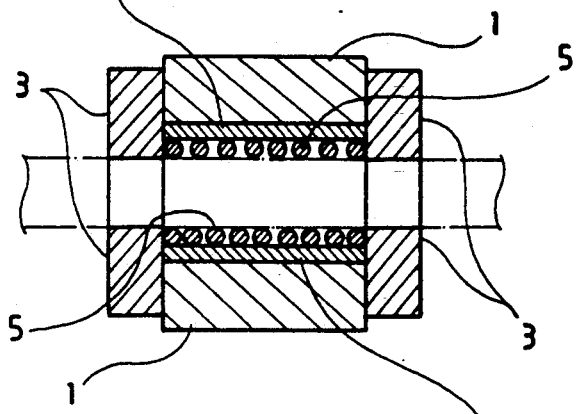
FIG. 1 shows an assembled, longitudinal cross-section view of a focus magnet according to an embodiment of the present invention.

FIG. 1 is an assembled, longitudinal cross-section view showing a focus magnet of the present invention. In the drawing, reference numeral 1 denotes a magnet having a penetrating hole 2 in which a neck portion (not shown) of a cathode-ray tube is inserted, and a pair of ring-shaped yokes 3 are mounted at both sides thereof. The magnet 1 is adapted to focus an electron beam emitted from an electron gun (not shown). A coil 5 is inserted and mounted in the penetrating hole 2 of the magnet 1 through a ring-shaped non-magnetic heat insulating member 4.

Here, the heat insulating member 4 is made of plastic material, more preferably, polypenylene oxide regenerated. Preferably, the heat insulating member 4 has a thickness selected from a range between 0.01 mm and 10 mm. In this case, if the thickness of the heat insulating member 4 is less than 0.01 mm, it allows to obtain an certain insulating effect relative to the heat transmitted from the CRT, but it has a poor shock-resistance and is difficult to manufacture it. On the contrary, if the thickness of the heat insulating member 4 is greater than 10 mm, it allows to obtain an excellent insulating effect, but it leads to increase a manufacturing cost. For this reason, the thickness of the heat insulating member 4 of the present invention is set to be in the range between 0.01 mm and 10 mm.

In the focus magnet according to the present invention, the heat insulating member 4 cut off the heat transmitted by passing through a neck portion and the heat generated in the coil 5 during the operation of the cathode-ray tube to minimize the amount of heat transmitting to the magnet 1, so that the magnet 1 is scarcely affected by the above mentioned heat. Accordingly, the magnetic field characteristics may not be changed so as to improve its focusing characteristics.

Figure 2:
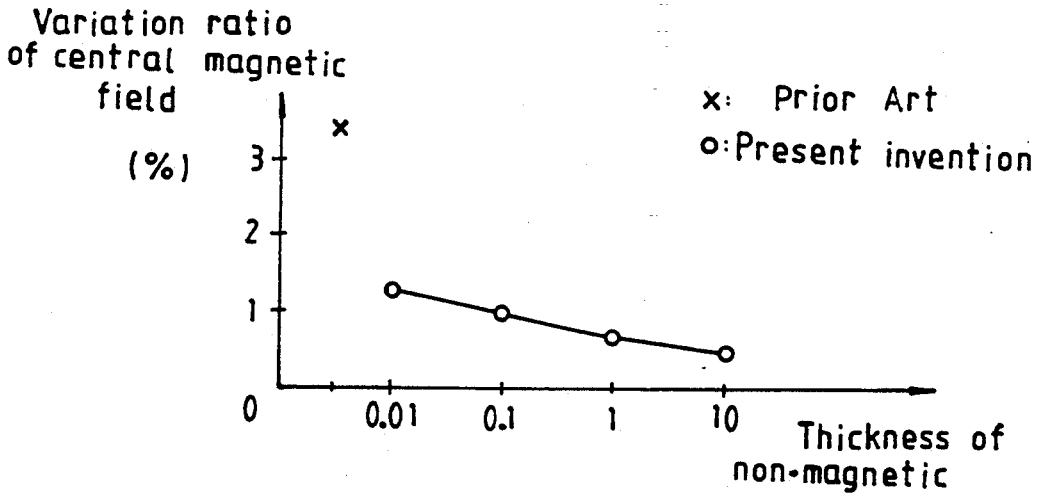
FIG. 2 (*a*) is a graph showing a variation ratio of a central magnetic field with respect to a thickness of an heat insulating member, and FIG. 2 (*b*) is a graph showing a variation of a degree of roundness of each sample.
Figure 2:
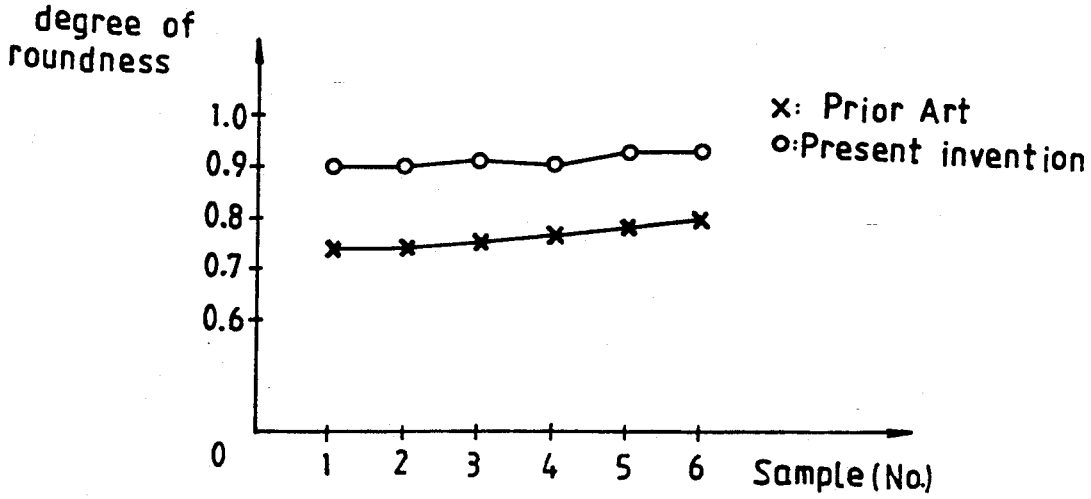
Figure 4:
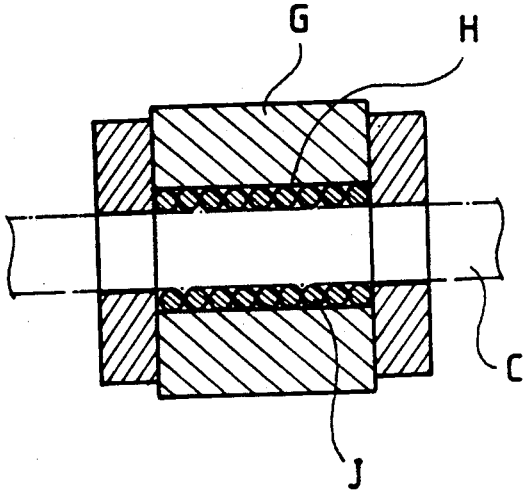
FIG. 4 (PRIOR ART)
FIG. 4 is an assembled cross-section view showing a conventional focus magnet similar to that of FIG. 1 and, FIG. 5 is a schematic front side view of a conventional projection type cathode-ray tube.
Figure 5:
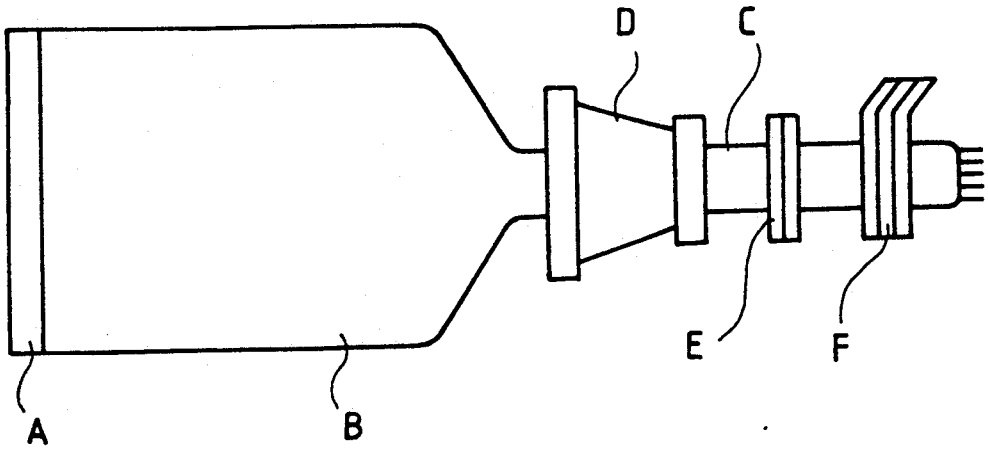
FIG. 5 (PRIOR ART)

FIG. 2 is a graph showing a comparison result of the focus magnet having the heat insulating member 4 according to the present invention with the conventional focus magnet shown in FIG. 4. That is, FIG. 2 (*a*) shows a variation ratio of a central magnetic field relativ to the thickness of the heat insulating member 4. As shown from FIG. 2 (*a*), the focus magnet according to the present invention is remarkably reduced in variation ratio of the central magnetic field than that of the conventional focus magnet. And, FIG. 2 (*b*) illustrates that a degree of roundness of the coil wound within the respective magnet samples is considerably improved than that of the conventional focus magnet.

Figure 3:
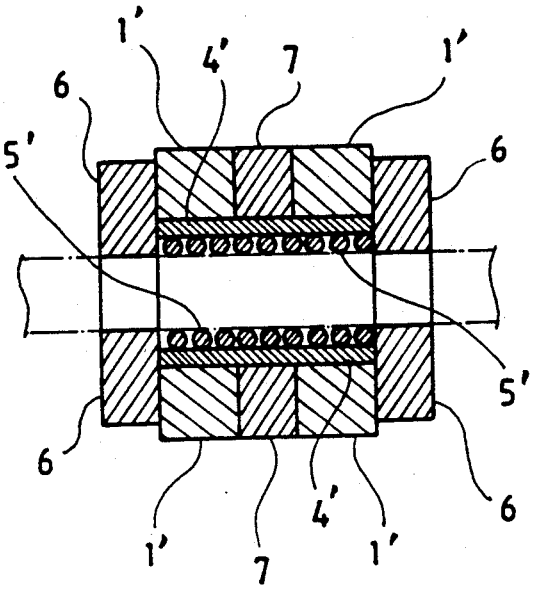
FIG. 3 is an assembled cross-section view of a focus magnet according to a modified embodiment of the present invention.

Meanwhile, the above embodiment has been described referring to the construction of the focus magnet having a heat insulating member 4 inserted between the ring-shaped magnet 1 and the coil 5. But, the present invention is not limited to the above construction and it will be obvious to those having skill in the art that many changes may be made thereto. For example, as shown in FIG. 3, a pair of magnets 1' can be mounted between a pair of side yokes 6 and a central yoke 7, and a coil 5' also can be disposed at the inner portion of the respective magnets 1 through a heat insulating member 4'. In this case, it is, of course noted that the heat generated in the coil 5' can be cut off not to be transferred to the magnets 1', thereby reducing the variation ratio of the central magnetic field of the focus magnet and improving a degree of roundness of the coil 5' wound within the magnets 1'.

As described above, according to the focus magnet of the present invention, since the heat insulating member cut off the heat generated at the neck portion of the CRT and the coil and transmitted to the magnet, it can prevent the deterioration of the focusing characteristics of the magnet due to the heat in the operation of the cathode-ray tube for a long time. As a result, it is possible to manufacture a high quality focus magnet where the magnet can be stably preserved in its characteristics and the degree of roundness of the coil can be improved.

What is claimed is:

1. A focus magnet inserted in a neck portion of a projection type cathode-ray tube for focusing an electron beam emitted from an electron gun, the focus magnet comprising:
   - a magnet having a penetrating hole formed therein, said magnet being inserted at said neck portion;
   - ring-shaped yokes mounted at both sides of said magnet;
   - a coil wound within said penetrating hole of said magnet; and
   - a non-magnetic heat insulating member inserted between said magnet and said coil wherein the non-magnetic heat insulating member is made of polypenylene oxide regenerated.

2. A focus magnet inserted in a neck portion of a projection type cathode-ray tube for focusing an electron beam emitted from an electron gun, the focus magnet comprising:
   - first and second magnets each having a penetrating hole formed therein and each having an inner side and an outer side, wherein said magnets are inserted in said neck portion;
   - a central yoke mounted between said first and second magnets, wherein said central yoke faces the inner sides of the first and second magnets;
   - a first yoke mounted adjacent to said outer side of the first magnet;
   - a second yoke mounted adjacent to said outer side of the second magnet;
   - a coil wound within said penetrating holes of said first and second magnets; and
   - a non-magnetic heat insulating member inserted between said first and second magnets and said coil.

3. The focus magnet according to claim 2, wherein said non-magnetic heat insulting member has a thickness selected from a range between 0.01 mm and 10 mm.

4. The focus magnet according to claim 2, wherein said non-magnetic heat insulting member is made of plastic material.

5. The focus magnet according to claim 4, wherein said non-magnetic heat insulating member is made of polypenylene oxide regenerated.

* * * * *

UNITED STATES PATENT AND TRADEMARK OFFICE

CERTIFICATE OF CORRECTION

PATENT NO. : 5,227,752

DATED : JULY 13, 1993

INVENTOR(S) : SUNG-U HAM

It is certified that error appears in the above-identified patent and that said Letters Patent is hereby corrected as shown below:

Column 4, line 57, in Claim 3: Replace "insulting" with --insulating--

Column 4, line 60, in Claim 4: Replace "insulting" with --insulating--

Signed and Sealed this

Twenty-sixth Day of April, 1994

Bruce Lehman

*Attest:*

BRUCE LEHMAN

*Attesting Officer*

*Commissioner of Patents and Trademarks*